US011739637B2

(12) United States Patent
Xiao et al.

(10) Patent No.: US 11,739,637 B2
(45) Date of Patent: Aug. 29, 2023

(54) SELF-PROPELLED TOWING SIMULATOR FOR DEEP-SEA MINING SYSTEM APPLICABLE TO NATURAL WATER BODIES AND SIMULATION METHOD USING THE SAME

(71) Applicant: SHANDONG UNIVERSITY OF SCIENCE AND TECHNOLOGY, Qingdao (CN)

(72) Inventors: Linjing Xiao, Qingdao (CN); Yu Wang, Qingdao (CN); Yulong Zhang, Qingdao (CN); Yanxin Li, Qingdao (CN); Qinghui Song, Qingdao (CN); Qiang Liu, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 17/781,812

(22) PCT Filed: Apr. 16, 2021

(86) PCT No.: PCT/CN2021/087621
§ 371 (c)(1),
(2) Date: Jun. 2, 2022

(87) PCT Pub. No.: WO2022/205516
PCT Pub. Date: Oct. 6, 2022

(65) Prior Publication Data

US 2023/0134633 A1 May 4, 2023

(30) Foreign Application Priority Data

Apr. 2, 2021 (CN) ..... 202110358790.0

(51) Int. Cl.
*E21C 50/02* (2006.01)
*B63B 21/56* (2006.01)
*B63B 21/66* (2006.01)

(52) U.S. Cl.
CPC ..... *E21C 50/02* (2013.01); *B63B 21/56* (2013.01); *B63B 21/66* (2013.01)

(58) Field of Classification Search
CPC ..... E21C 50/02; B63B 21/56; B63B 21/66
See application file for complete search history.

(56) References Cited

FOREIGN PATENT DOCUMENTS

CN 106611540 A 5/2017
CN 107121151 A 9/2017

OTHER PUBLICATIONS

International Search Report issued in International Application No. PCT/CN2021/087621; dated Jan. 5, 2022; 9 pgs.

(Continued)

*Primary Examiner* — Tara Mayo
(74) *Attorney, Agent, or Firm* — HAUPTMAN HAM, LLP

(57) ABSTRACT

A self-propelled towing simulator for a hydraulic lift system carries a gyro pose control system and a six-degree-of-freedom (DOF) platform to control the overall pose of the simulator, so that the simulator simulates six-DOF motion states including swaying, surging, yawing, rolling, pitching and heaving generated by a mining vessel under the combined action of waves and flows and required by the experimental working conditions; interventions in the pose of the simulator may be positive or negative, so that the simulator may be applied to the uncontrollable natural water bodies so as to approximate to the working conditions of the experimental requirements. The simulator may carry out experiments in open natural water bodies by use of its own autonomous sailing capability under remote wireless control (Continued)

and may acquire parameters such as dynamic characteristics and spatial configuration and the like of a deep-sea mining hydraulic lift subsystem in real time.

10 Claims, 3 Drawing Sheets

(56) References Cited

OTHER PUBLICATIONS

Written Opinion issued in International Application No. PCT/CN2021/087621; dated Jan. 5, 2022; 10 pgs.
Search Report issued in corresponding Chinese Application No. 2021103587900; dated Aug. 27, 2021; 3 pgs.
First Office Action issued in corresponding Chinese Application No. 2021103587900; dated Sep. 7, 2021; 7 pgs.
Second Office Action issued in corresponding Chinese Application No. 2021103587900; dated Nov. 9, 2021; 7 pgs.
Notice of Grant issued in corresponding Chinese Application No. 2021103587900; dated Jan. 7, 2022; 3 pgs.

SELF-PROPELLED TOWING SIMULATOR FOR DEEP-SEA MINING SYSTEM APPLICABLE TO NATURAL WATER BODIES AND SIMULATION METHOD USING THE SAME

RELATED APPLICATIONS

The present application is a U.S. National Phase of International Application Number PCT/CN2021/087621, filed Apr. 16, 2021, and claims priority to Chinese Application Number 2021103587900, filed Apr. 2, 2021.

TECHNICAL FIELD

The present disclosure belongs to the technical field of experiment devices of deep-sea mining system, in particular to a self-propelled towing simulator for a deep-sea mining system applicable to natural water bodies and a simulation method using the same.

BACKGROUND

Deep-sea mining is an operation of continuously and efficiently mining deep-sea poly-metallic nodules and transporting them to surface mining vessels under the influence of complex marine environmental factors. Because the minings are mostly carried out in the environment of ocean floor deposits at a water depth of 4000-6000 meters, a deep-sea mining system has a hydraulic lift subsystem with long complex pipelines, and additionally, the operation process includes the procedures such as deployment, towing navigation, obstacle-avoiding navigation, steering navigation, continuous complicated mining path planned navigation, and recovery, etc. At present, tests and experiments on a small-scale-ratio model of the deep-sea mining system are usually carried out in a large dynamic experimental water pool with a function of making wave and wind. If a flow making function needs to be added, it is required to carry out tests and experiments on a smaller-scale-ratio model in a large circulating water channel. It has been a trouble that relatively small scale ratios may result in inaccuracy and experimental sites cannot meet multi-direction navigation conditions due to size limitation. So, it is urgent to need a high Reynold number fluid dynamic testing device of a large-scale-ratio test model, which is more compliant with actual operation conditions. Therefore, the present disclosure provides a self-propelled towing simulator for a deep-sea mining system applicable to natural water bodies and a simulation method thereof. The simulator may carry out experiments in open natural water bodies by use of its own autonomous sailing capability under remote wireless control, so as to simulate motion circumstances of six degrees of freedom (DOF) of a mining vessel at various levels of sea conditions and collect parameters such as dynamic characteristics and spatial configurations and the like of a deep-sea mining hydraulic lift subsystem in real time. Furthermore, more comprehensive and accurate tests and experiments can be carried out on a deep-sea mining system.

SUMMARY

In order to carry out more comprehensive and accurate tests and experiments of a deep-sea mining system by simulation, the present disclosure provides a self-propelled towing simulator for a deep-sea mining system applicable to natural water bodies and a simulation method using the same. The simulator may carry out experiments in open natural water bodies by use of its own autonomous sailing capability under remote wireless control, so as to simulate motion circumstances of six degrees of freedom (DOF) of a mining vessel at various levels of sea conditions. Due to reasonable designing, the simulator can overcome the deficiencies in the prior art, and thus produce good effects.

The present disclosure provides a self-propelled towing simulator for a deep-sea mining system applicable to natural water bodies, which includes a floating body unit, a workbench, a propulsion system, a wave height determination system, an underwater acoustic positioning system, a flow velocity determination system, a radio communication system, a GPS positioning system, a gyro pose control system, a six-DOF platform, a central control cabinet, an experimental hydraulic lift rigid-tube model and a quickly-removable battery box. The floating body unit is fixedly connected to the workbench through a cross beam structure, the central control cabinet and the quickly-removable battery box are respectively disposed at the front and rear ends of an upper work surface of the workbench, the propulsion system is disposed at the tail part of the simulator, and the wave height determination system, the underwater acoustic positioning system and the flow velocity determination system are all disposed on a lower work surface of the work bench. The middle part of the workbench is provided with a center-of-gravity projection hole. A working tower secured at two side parts of the center-of-gravity projection hole is disposed on the workbench. The six-DOF platform is secured in a suspended manner at the upper part of the working tower. The gyro pose control system is secured in a suspended manner at the lower part of the six-DOF platform. A center-of-circle of the center-of-gravity projection hole, a center-of-gravity of the gyro pose control system and a center-of-gravity of the six-DOF platform all overlap with a vertical projection of an overall center-of-gravity of the simulator. Six-DOF motion states including swaying, surging, yawing, rolling, pitching and heaving generated by a mining vessel may be simulated through collaborative linkage of the gyro pose control system and the six-DOF platform. The radio communication system and the GPS positioning system are secured on two sides of the top of the working tower, and an ultra-large wide-angle vision system is disposed at the top of the radio communication system. The experimental hydraulic lift rigid-tube model is connected to the center-of-gravity projection hole, or, is passed through the center-of-gravity projection hole to be connected to the bottom of the gyro pose control system.

Further, the floating body unit is composed of a first floating body material and a second floating body material, where the first floating body material and the second floating body material are respectively disposed on the left and right sides of the simulator, the first floating body material and the second floating body material both are of a hollow cavity structure internally filled with gravels or nibbles, the bottom of the first floating body material is provided with a first filling valve, and the bottom of the second floating body material is provided with a second filling valve.

Further, the cross beam structure includes a first cross beam, a second cross beam and a third cross beam, where the first floating body material and the second floating body material are fixedly connected by the first cross beam, the second cross beam and the third cross beam, and the tops of the three cross beams are all fixedly connected to the workbench.

Further, the propulsion system includes a main propulsion system, a first side propulsion system and a second side propulsion system, where the main propulsion system is disposed at the rear end of the workbench, the first side propulsion system is disposed at the rear end of the second floating body material, and the second side propulsion system is disposed at the rear end of the first floating body material. The main propulsion system, the first side propulsion system and the second side propulsion system may independently control a propulsion angle and a propeller speed.

Further, the bottom of the quickly-removable battery box is provided with a plurality of universal buckles which can be fixedly buckled at a plurality of locations on the upper work surface of the workbench.

Further, the six-DOF platform is composed of an upper platform surface, universal joints, telescopic cylinders and a lower platform surface, where the upper platform surface is fixedly connected to the working tower through bolts, the number of the telescopic cylinder is six, and two ends of the telescopic cylinders are respectively connected to the upper and lower platform surfaces through the universal joints.

Further, the gyro pose control system is composed of a dy rotary table, a gyro shell, an access cover, a dx rotary shaft and an extension interface. The dy rotary table is fixedly connected to the lower platform surface through bolts. The access cover is disposed on the gyro shell, and a large-mass gyrostat which can rotate at a high speed is disposed in an inner cavity of the gyro shell. The dy rotary table rotates relative to a main body of a six-DOF motion pose control system, the gyro shell may rotate along the dx rotary shaft, and the extension interface is arranged at a lower end part of the gyro pose control system.

Further, the experimental hydraulic lift rigid-tube model is connected to the center-of-gravity projection hole of the workbench through a lock-carrying universal joint, or, passed through the center-of-gravity projection hole to be directly connected to the extension interface through the lock-carrying universal joint.

The present disclosure provides a simulation method using the self-propelled towing simulator for a deep-sea mining system applicable to natural water bodies, which includes the following steps:

At step 1: a buoyancy desired by the simulator is determined according to parameters such as scale ratio, mass and self-buoyancy of a to-be-tested experimental model, and then a mass of fillings required in the cavity of the floating body unit is determined.

At step 2: the quickly-removable battery box is mounted in the center of the rear end of the workbench.

At step 3: the simulator is lowered to a water surface through a wharf or a mother ship, and a main power switch located on a panel of the central control cabinet is turned on to carry out all-round self-inspection and no-load running-in and acquire data as experimental control sample data and zero point punctuation reference, so as to confirm that the simulator is in normal state.

At step 4: the to-be-tested experimental model is lowered to the water surface through a wharf or a mother ship, and an experimental hydraulic lift rigid-tube model part of the to-be-tested experimental model is connected to a center-of-gravity projection hole part at the lower part of the workbench through a lock-carrying universal joint.

At step 5: the pose of the simulator is detected, and if the simulator deflects, the overall pose balancing of the simulator is performed by adjusting the position of the quickly-removable battery box back and forth or right and left on the upper work surface of the workbench.

At step 6: according to working condition requirements of an experiment, program setting is performed remotely through a console, to arbitrarily and independently match the working condition simulation functions of the simulator.

At step 7: the simulator performs preliminary processing for the obtained data by the central control cabinet, and then interacts data with a remote console through the radio communication system.

At step 8: experimenters verify whether the data acquired by each sensor of the simulator is valid and normal in real time, so as to control the progress of the experiment and adjust the scheme of the experiment.

At step 9: after the experiment is completed, the simulator is recovered through a wharf or a mother ship, then cleaned, maintained, and placed properly for next use.

Further, the working condition simulation functions of the simulator in step 6 include the following functions:

Pose simulation: the simulator simulates the six-DOF motion states including swaying, surging, yawing, rolling, pitching and heaving generated by a mining vessel through collaborative linkage of the gyro pose control system and the six-DOF platform. The intervention for the pose of the simulator may be positive or negative, so that the simulator may be applied to the uncontrollable natural water bodies so as to approximate to the working conditions of the experimental requirements by reducing or increasing sway or swing.

Towing navigation: the main propulsion system, the first side propulsion system and the second side propulsion system carried on the simulator each may independently control a propulsion angle and a propeller speed, such that by changing the propeller speed, the simulator can simulate the working conditions such as constant speed towing navigation, constant and variable speed towing navigation, variable acceleration towing navigation, various complicated mining path planned navigations and steering navigations of various radiuses.

Steering towing navigation: the main propulsion system, the first side propulsion system and the second side propulsion system carried on the simulator each may independently control a propulsion angle and a propeller speed, such that, by changing the propulsion angle and the propeller speed, various types of curvilinear motions can be achieved so as to simulate the working conditions of various path planned towing navigations of a mining vessel.

Excitation vibration: the gyro pose control system and the six-DOF platform carried on the simulator may apply a high-frequency vibration to the simulator, and transfer the high-frequency vibration to the experimental hydraulic lift rigid-tube model through a main body structure of the simulator, or, more directly produce the excitation vibration by making direct connection with the extension interface at the lower part of the gyro pose control system through a lock-carrying universal joint, so as to observe the dynamic response characteristics of a hydraulic lift pipeline system.

Switching of hinging and fixed connection: the lock-carrying universal joint has two horizontal shafts orthogonal to each other, which may provide free rotations of two DOFs, so that the lock-carrying universal joint connects the top end of the hydraulic lift rigid-tube to the simulator by hinging, for example, may connect the top end of the hydraulic lift rigid-tube to the simulator after independently restricting the rotation of any one of the two horizontal shafts, or connect the top end of the hydraulic lift rigid-tube to the simulator by fixed connection after restricting the rotations of the two horizontal shafts.

Beneficial effects: the simulator may carry out simulation experiment in an open natural water bodies, which fills a technical blank that a deep-sea mining system cannot carry out experiment items such as complex towing navigation, obstacles-avoiding navigation, large-radius steering navigation, continuous complicated mining path planned navigation, and the like due to a hydraulic lift subsystem with a complex long pipeline in a laboratory water bodies of a given size. Due to its own autonomous sailing capability, under the remote wireless control, the simulator can simulate six-DOF motion conditions of a mining vessel at various levels of sea conditions by use of its own functions without waiting for an appropriate sea condition and acquire parameters such as dynamic characteristics and spatial configurations of a deep sea mining hydraulic lift subsystem in real time. Further, various manners including filling the floating body materials, displacing the quickly-removable battery box and the like are provided to achieve fast balancing without adding counterweights, thereby saving lots of time. That is, specifically, on the premise of improving the stability through main structure design, the six-DOF motion states including swaying, surging, yawing, rolling, pitching and heaving generated by a mining vessel are simulated through collaborative linkage of the gyro pose control system and the six-DOF platform. The intervention for the pose of the simulator may be positive or negative, so that the simulator may be applied to the uncontrollable natural water bodies so as to approximate to the working conditions of the experimental requirements by reducing or increasing sway or swing. Through three independent propulsion systems, working conditions such as constant speed towing navigation, constant and variable speed towing navigation, variable acceleration towing navigation, various complicated mining path planned navigations and steering navigations of various radiuses and the like can be simulated. The simulator disclosed by the present disclosure is reasonably designed and overcomes the deficiencies in the prior art, thereby saving high cost of ship chartering for sea trials; further, more comprehensive and accurate tests and experiments on a deep-sea mining system can be carried out more conveniently and freely without waiting for a scheduled date of the test vessel and appropriate seasons, climates and sea conditions, bringing good effect and significantly improving the experimental efficiency.

DETAILED DESCRIPTION OF THE EMBODIMENTS

Figure 1:
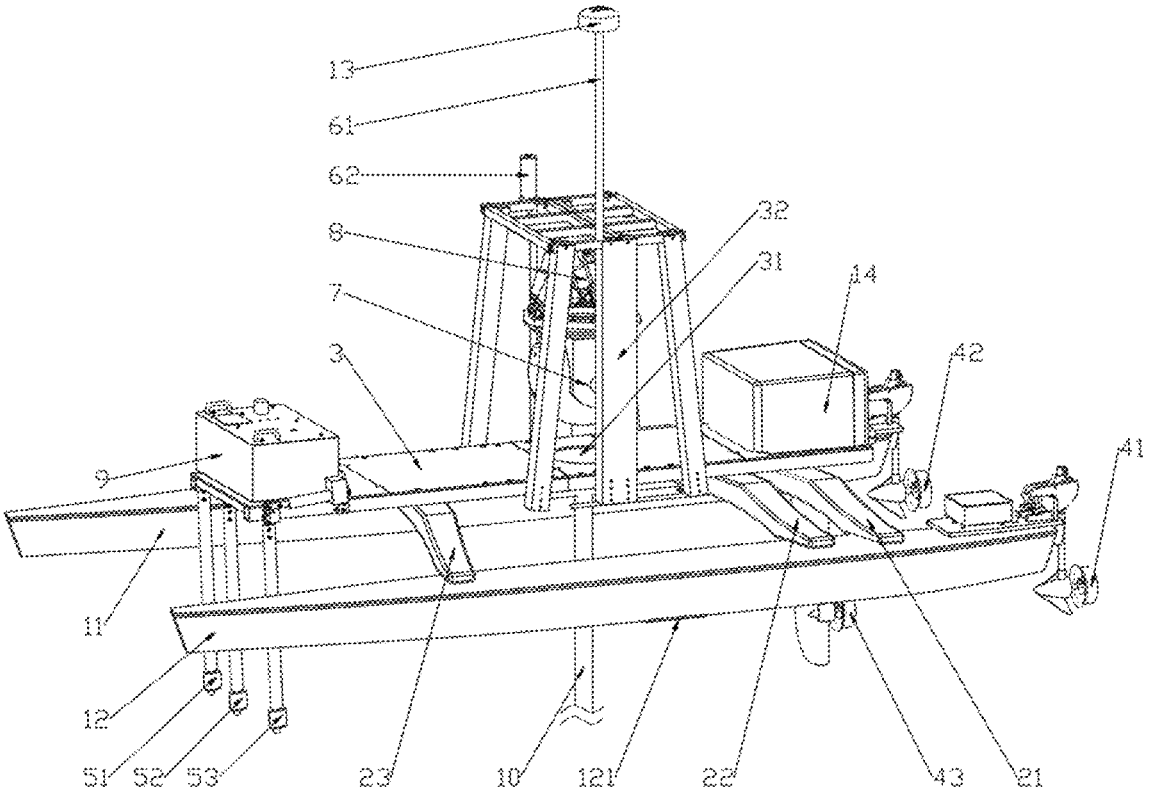
FIG. 1 is a structural axonometric diagram of a simulator according to the present disclosure.
Figure 2:
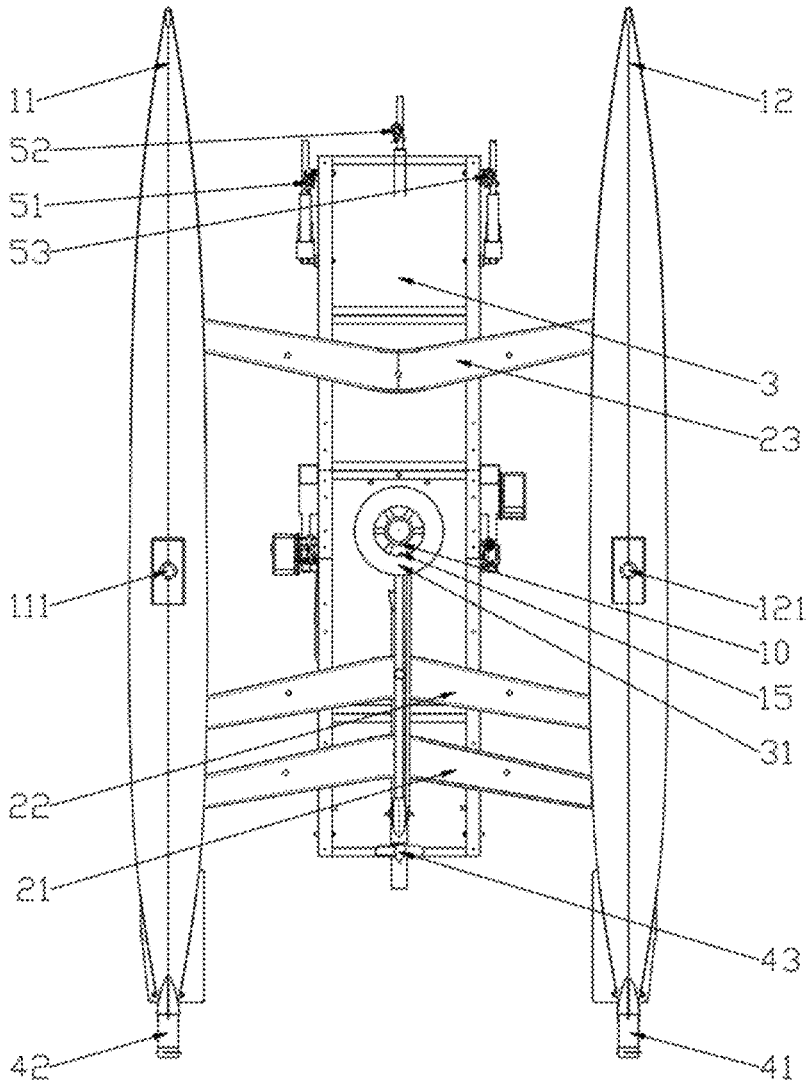
FIG. 2 is a structural bottom view of a simulator according to the present disclosure.
Figure 3:
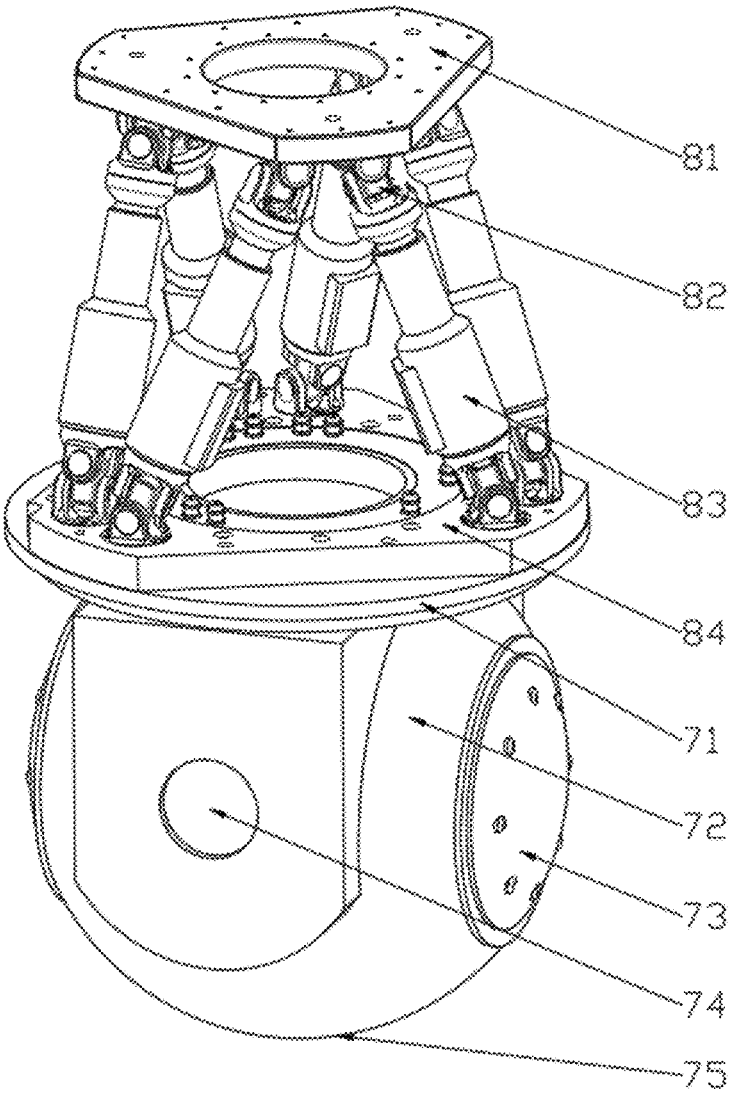
FIG. 3 is a structural axonometric diagram of a gyro pose control system and a six-DOF platform according to the present disclosure.

To illustrate the purpose, technical solutions and advantages of the present disclosure more clearly, the followings further describe the present disclosure in details with reference to accompanying embodiments. It should be understood that the embodiments described herein are only used to interpret this present disclosure, and are not intended to limit this present disclosure, i.e., the described embodiments are merely some embodiments of the present disclosure rather than all embodiments of the present disclosure.

The first floating body material 11 and the second floating body material 12 are respectively disposed at the left and right sides of a simulator of the present disclosure, and fixedly connected by three cross beams, i.e., a first cross beam 21, a second cross beam 22 and a third cross beam 23, where the tops of the three cross beams are fixedly connected to a workbench 3.

The arrangement of the two floating body materials at the left and right sides is intended to improve the overall stability of the simulator, and thus improve the overall pose controllability of the simulator, and overcome uncontrollable disturbance of a natural water body. Moreover, a large space in the middle of the simulator may be set aside for the arrangement and installation of experimental devices such as hydraulic lift rigid-tubes and the like, so as to leave a working space for later recovery and deployment of the hydraulic lift rigid-tubes.

The middle part of the workbench 3 is provided with a center-of-gravity projection hole 31, a working tower 32 secured at the two side parts of the center-of-gravity projection hole 31 is disposed on the workbench 3, and a six-DOF platform 8 is secured in a suspended manner at the upper part of the working tower 32. A gyro pose control system 7 is secured in a suspended manner at the lower part of the six-DOF platform 8. A center-of-circle of the center-of-gravity projection hole 31, a center-of-gravity of the gyro pose control system 7 and a center-of-gravity of the six-DOF platform 8 all overlap with a vertical projection of an overall center-of-gravity of the simulator.

This design described herein is to further improve the overall pose control capability of the simulator. Among the systems of the simulator, the gyro pose control system 7 has a largest and most concentrated mass, and is fixed by suspension to make its position closer to the overall center-of-gravity of the simulator. Firstly, a large-mass gyrostat capable of rotating at a high speed is disposed inside the gyro pose control system 7, so that the overall pose of the simulator can be intervened by using conservation of angular momentum and gyro stability. Secondly, with the assistance of the six-DOF platform 8, the gyro pose control system 7 can move freely at six DOFs within a certain scope in a space based on a principle of intervening in the overall pose of the simulator by changing a spatial position of the gyro pose control system 7 having a large mass and a large gyro stability. Finally, the uncontrollability of real-time sea conditions in a natural water bodies can be compensated through the gyro pose control system 7 and the six-DOF platform 8 during an experiment, so as to satisfy the relevant requirements of the experiment.

The main propulsion system 43 is disposed at a rear end 3 of the workbench 3, the first side propulsion system 41 is disposed at a rear end of the second floating body material 12, and the second side propulsion system 42 is disposed at a rear end of the first floating body material 11.

This design described herein is to improve the overall navigation flexibility of the simulator, and satisfy complex towing navigation forms, acceleration forms and steering forms in the experimental conditions. The main propulsion system 43, the first side propulsion system 41 and the second side propulsion system 42 may independently control a propulsion angle and a propeller speed to produce a propulsion force of each direction. In this way, various motion forms such as in-situ steering and the like of the simulator can be achieved.

The first floating body material 11 is of a hollow cavity structure with its bottom provided with a first filling valve 111, and the second floating body material 12 is also of a hollow cavity structure, with its bottom provided with a second filling valve 121.

This design described herein is to change an overall buoyancy and a mass of the simulator. Materials such as gravels or stones may be filled into the hollow cavity structures of the floating body materials through the filling valves, so as to change the characteristics such as overall draft depth, inertia, center of gravity, and the like of the simulator, and thus the simulator can carry experimental models of various scale ratios.

A radio communication system 61 and a GPS positioning system 62 are secured on both sides of the top of the working tower 32, and an ultra-large wide-angle vision system 13 is disposed at the top end of the radio communication system 61.

The simulator runs based on an unmanned operation mode, and can be operated remotely through a console at a mother ship or a wharf by means of wireless communication. The location information of the simulator itself needs to be acquired in real time through the GPS, and the location information, real-time data streams of experimental sensors, and navigation visual image information are all interacted with the console via radio. The radio communication system 61 is located at the highest position of the simulator, therefore, the ultra-large wide-angle vision system 13 arranged on the radio communication system 61 can facilitate image visual observation on navigation environment around the simulator and operation state of each device in the simulator.

A central control cabinet 9, a wave height determination system 51, an underwater acoustic positioning system 52 and a flow velocity determination system 53 are all arranged at a front end of the workbench 3. A quickly-removable battery box 14 is arranged at a rear end of the workbench 3, and the bottom of the quickly-removable battery box 14 is provided with a plurality of universal buckles which can be fixedly buckled at a plurality of locations on an upper work surface of the workbench 3.

A core component of the wave height determination system 51 is a wave gauge configured to monitor a wave height of a water surface in real time; a core component of the flow velocity determination system 53 is a flow meter configured to measure a real-time water flow velocity; and the underwater acoustic positioning system 52 is used to realize, based on underwater acoustic positioning system technology, the real-time acquisition of the location information of various underwater experimental components such as underwater hydraulic lift rigid-tubes, pump sets, a central ore bin, hydraulic lift flexible-tubes and ocean mining machines and the like, and then calculate the spatial configurations of all the underwater components. The wave height determination system 51, the underwater acoustic positioning system 52 and the flow velocity determination system 53 are all disposed at the front end of the workbench 3, with the purpose of allowing them to be located at the foremost end of the flow-coming direction so as to be free from the subsequent influences of the structures such as the experimental hydraulic lift rigid-tube model 10, the first side propulsion system 41, the second side propulsion system 42, the main propulsion system 43, the first floating body material 11, the second floating body material 12 and the like on water flows, thereby ensuring the accuracy of data acquired by the sensors.

The bottom of the quickly-removable battery box 14 is provided with a plurality of universal buckles which can be fixedly buckled at a plurality of locations on the upper work surface of the workbench 3. The center-of-gravity position of the whole experimental simulator is adjusted by use of the mass of the quickly-removable battery box 14 to achieve quick balancing, and further, the battery of the simulator can be conveniently replaced for energy replenishment.

In the gyro pose control system 7, a dy rotary table 71 is fixedly connected to a lower platform surface 84 through bolts, an access cover 73 is disposed on a gyro shell 72, and a gyrostat is disposed in an inner cavity of the gyro shell. The dy rotary table 71 also rotates relative to a main body of the six-DOF motion pose control system 7, and the gyro shell 72 may rotate along a dx rotary shaft 74.

The six-DOF platform 8 fixedly connects an upper platform surface 81 to a working tower 32 by bolts. The six-DOF platform 8 includes six same telescopic cylinders 83, and two ends of the telescopic cylinder 83 are respectively connected to the upper platform surface 81 and the lower platform surface 84 through a universal joint 82.

Under the premise that the upper platform surface 81 is fixed to the main body structure of the simulator by the working tower 32, at this moment, by simultaneously changing the strokes of the six telescopic cylinders 83 according to a certain logic, the gyro pose control system 7 can be driven by the lower platform surface 84 to move at any of six DOFs within a certain space, thus achieving intervention for the overall pose of the simulator. Because a mining vessel in real experimental sea conditions is sensitive to yawing and rolling, the dy rotary table 71 and the dx rotary shaft 74 in the gyro pose control system 7 may provide continuous large-angle rotations of two DOFs, which further increases the intervening capability for the overall pose of the simulator.

The experimental hydraulic lift rigid-tube model 10 is connected to the center-of-gravity projection hole 31 of the workbench 3 through a lock-carrying universal joint 15, or, may pass through the center-of-gravity projection hole 31 to be directly connected to the extension interface 75 at the lower part of the gyro pose control system 75 through the lock-carrying universal joint 15.

The lock-carrying universal joint 15 may connect the top end of the hydraulic lift rigid-tube to the simulator by hinging, also may independently restrict any one of the two shafts, or restrict both shafts to change the connection form into fixed connection. In a conventional experiment, the experimental hydraulic lift rigid-tube model 10 is connected to the center-of-gravity projection hole 31 of the workbench 3 through a lock-carrying universal joint 15, at this time, natural water acts on the simulator in real time, and the overall pose of the simulator is controlled to meet the requirements of experimental conditions through the collaborative linkage of the gyro pose control system 7 and the six-DOF platform 8, and then the simulator transmits an influence to an experimental subject through the workbench 3. If experiment is carried out under extreme conditions, the experimental hydraulic lift rigid-tube model 10 also may pass through the center-of-gravity projection hole 31 to be directly connected to the extension interface 75 at the lower part of the gyro pose control system 75 through the lock-carrying universal joint 15. At this moment, the collaborative linkage of the gyro pose control system 7 and the six-DOF platform 8 directly acts on the hydraulic lift rigid-tube in such a way that the influence of sea waves on the simulator, that is, in an experimental scene, the influences of different sea conditions on a mining vessel are weakened.

A specific experimental simulation method of the self-propelled towing simulator for a deep-sea mining system applicable to natural water bodies includes the following steps.

At step 1, a buoyancy desired by the simulator is determined according to parameters such as scale ratio, mass and self-buoyancy and the like of a to-be-tested experimental model, and then the masses of fillings required in the cavities of the first floating body material 11 and the second floating body material 12 are determined, wherein the fillings in the cavities are adjusted by the first filling valve 111 and the second filling valve 121, but mass equivalence on both sides should be ensured, and the fillings may be solid bulk materials such as gravels or stones and the like.

At step 2: the quickly-removable battery box 14 is mounted in the center of the rear end of the workbench 3.

At step 3: the simulator is lowered to a water surface through a wharf or a mother ship, and a main power switch located on a panel of the central control cabinet 9 is turned on to carry out all-round self-inspection and no-load running-in and acquire data as experimental control sample data and zero point punctuation reference, so as to confirm that the simulator is in normal state.

At step 4: the to-be-tested experimental model is lowered to the water surface through a wharf or a mother ship, and an experimental hydraulic lift rigid-tube model 10 part of the to-be-tested experimental model is connected to the center-of-gravity projection hole 31 part at the lower part of the workbench 3 through a lock-carrying universal joint.

At step 5: the pose of the simulator is detected. If the simulator deflects, the overall pose balancing of the simulator may be performed by changing the position of the quickly-removable battery box back and forth or right and left on the upper work surface of the workbench 3 through a plurality of universal buckles at the bottom of the quickly-removable battery box 14, wherein during an experiment, if a console receives a prompt indicating a low battery of the simulator, a backup quickly-removable battery box 14 may be used.

At step 6: according to the working condition requirements of the experiment, program setting is performed remotely through the console to independently match each working condition simulation function of the simulator:

Working condition simulation function 1: pose simulation. The gyro pose control system 7 and the six-DOF platform 8 carried on the simulator are mainly configured to control the overall pose of the simulator, so that the simulator may simulate six-DOF motions which are generated by a mining vessel under the combined action of waves and flows and required by experimental working conditions, that is, six-DOF motion states including swaying, surging, yawing, rolling, pitching and heaving generated by the mining vessel are simulated through the collaborative linkage of the gyro pose control system 7 and the six-DOF platform 8. Interventions for the pose of the simulator may be positive or negative, so that the simulator may be applied to the uncontrollable natural water bodies so as to approximate to the working conditions of the experimental requirements by reducing sway or swing.

Working condition simulation function 2: towing navigation. The main propulsion system 43, the first side propulsion system 41 and the second side propulsion system 42 of the simulator each may independently control a propulsion angle and a propeller speed, such that, by changing the propeller speed, the simulator can simulate the working conditions such as constant speed towing navigation, constant and variable speed towing navigation, variable acceleration towing navigation, various complicated mining path planned navigations and steering navigations of various radiuses.

Working condition simulation function 3: steering towing navigation. The main propulsion system 43, the first side propulsion system 41 and the second side propulsion system 42 carried on the simulator each may independently control a propulsion angle and a propeller speed, such that, by changing the propulsion angle and the propeller speed, various types of curvilinear motions may be realized so as to simulate the working conditions of various path planned towing navigations of the mining vessel.

Working condition simulation function 4: excitation vibration. The gyro pose control system 7 and the six-DOF platform 8 carried on the simulator may apply a high-frequency vibration to the simulator, and then transmit the high-frequency vibration to the experimental hydraulic lift rigid-tube model 10 through a main body structure of the simulator, or, more directly produce the excitation vibration by making direct connection with the extension interface at the lower part of the gyro pose control system 7 through a lock-carrying universal joint 15, so as to observe the dynamic response characteristics of a hydraulic lift pipeline system.

Working condition simulation function 5: switching of hinging and fixed connection. The lock-carrying universal joint has two horizontal shafts orthogonal to each other, which may provide free rotations of two DOFs, so that the lock-carrying universal joint connects the top end of a hydraulic lift rigid-tube to the simulator by hinging, and may connect the top end of the hydraulic lift rigid-tube to the simulator after independently restricting the rotation of any one of the two horizontal shafts, or, connect the top end of the hydraulic lift rigid-tube to the simulator by fixed connection after restricting the rotations of the two horizontal shafts.

At step 7, the GPS positioning system of the simulator is configured to acquire the location information of the simulator in real time; the wave height determination system 51 is configured to monitor the wave height of a water surface in real time; the underwater acoustic positioning system 52 is configured to acquire the location information of various underwater experimental components such as underwater hydraulic lift rigid-tubes, pump sets, a central ore bin, hydraulic lift flexible-tubes and an ocean mining machine and the like in real time; and the flow velocity determination system 53 is configured to measure a real-time water flow velocity, the ultra-large wide-angle vision system 13 will record data in real time, and record data acquired by various sensors such as a pull-pressure sensor, a strain sensor, a vibration sensor, an inertial navigation system and an acceleration sensor and the like set up along with the experimental model. Each data stream will be preliminarily processed in the central control cabinet 9 and then interacted with the remote console through the radio communication system 61.

At step 8: experimenters verify whether data acquired by each sensor of the simulator is valid and normal in real time, so as to control the progress of the experiment and adjust the scheme of the experiment.

At step 9: after the experiment is completed, the simulator is recovered through a wharf or a mother ship, then cleaned, maintained, and placed properly for next use.

Of course, the foregoing descriptions are not intended to limit the present disclosure, and the present disclosure is not limited to the above embodiments. Any change, modification, addition or replacement made by those skilled in the art without departing from the essential scope of the present disclosure shall fall within the protection scope of the present disclosure.

The invention claimed is:

1. A self-propelled towing simulator for a deep-sea mining system applicable to natural water bodies, the simulator comprising a floating body unit, a workbench, a propulsion system, a wave height determination system, an underwater acoustic positioning system, a flow velocity determination system, a radio communication system, a GPS positioning system, a gyro pose control system, a six-degree-of-freedom (DOF) platform, a central control cabinet, an experimental hydraulic lift rigid-tube model and a removable battery box, wherein the floating body unit is fixedly connected to the workbench through a cross beam structure, the central control cabinet and the removable battery box are respectively disposed at front and rear ends of an upper work surface of the workbench, the propulsion system is disposed at a tail part of the simulator, the wave height determination system, the underwater acoustic positioning system and the flow velocity determination system are all disposed on a lower work surface of the workbench, a middle part of the workbench is provided with a center-of-gravity projection hole, a working tower secured at the two side parts of the center-of-gravity projection hole is disposed on the workbench, the six-DOF platform is secured in a suspended manner at the upper part of the working tower, the gyro pose control system is secured in a suspended manner at the lower part of the six-DOF platform, a center-of-circle of the center-of-gravity projection hole, a center-of-gravity of the gyro pose control system and a center-of-gravity of the six-DOF platform all overlap with a vertical projection of the overall center-of-gravity of the simulator, six-DOF motion states including swaying, surging, yawing, rolling, pitching and heaving generated by a mining dredger are simulated through the collaborative linkage of the gyro pose control system and the six-DOF platform, the radio communication system and the GPS positioning system are secured on the two sides of the top of the working tower, an ultra-large wide-angle vision system is disposed at the top of the radio communication system, the experimental hydraulic lift rigid-tube model is connected to the center-of-gravity projection hole, or, passed through the center-of-gravity projection hole to be connected to the bottom of the gyro pose control system.

2. The self-propelled towing simulator for the deep-sea mining system applicable to natural water bodies according to claim 1, wherein the floating body unit is composed of a first floating body material and a second floating body material, wherein the first floating body material and the second floating body material are respectively disposed on the left and right sides of the simulator, the first floating body material and the second floating body material are respectively of a hollow cavity structure, which is internally filled with gravels or stones, the bottom of the first floating body material is provided with a first filling valve, and the bottom of the second floating body material is provided with a second filling valve.

3. The self-propelled towing simulator for the deep-sea mining system applicable to natural water bodies according to claim 2, wherein the cross beam structure comprises a first cross beam, a second cross beam and a third cross beam, the first floating body material and the second floating body material are fixedly connected by the first cross beam, the second cross beam and the third cross beam, and the tops of the three cross beams are all fixedly connected to the workbench.

4. The self-propelled towing simulator for the deep-sea mining system applicable to natural water bodies according to claim 2, wherein the propulsion system comprises a main propulsion system, a first side propulsion system and a second side propulsion system, the main propulsion system is disposed at a rear end of the workbench, the first side propulsion system is disposed at a rear end of the second floating body material, the second side propulsion system is disposed at a rear end of the first floating body material, and the main propulsion system, the first side propulsion system and the second side propulsion system respectively control a propulsion angle and a propeller speed independently.

5. The self-propelled towing simulator for the deep-sea mining system applicable to natural water bodies according to claim 1, wherein the bottom of the removable battery box is provided with a plurality of universal buckles which are fixedly buckled at a plurality of locations of the upper work surface of the workbench.

6. The self-propelled towing simulator for the deep-sea mining system applicable to natural water bodies according to claim 1, wherein the six-DOF platform is composed of an upper platform surface, universal joints, telescopic cylinders and a lower platform surface, the upper platform surface is fixedly connected to the working tower through bolts, the number of the telescopic cylinders is six, and two ends of the telescopic cylinders are respectively connected to the upper and lower platform surfaces through the universal joints.

7. The self-propelled towing simulator for the deep-sea mining system applicable to natural water bodies according to claim 6, wherein the gyro pose control system is composed of a dy rotary table, a gyro shell, an access cover, a dx rotary shaft and an extension interface, the dy rotary table is fixedly connected to the lower platform surface through bolts, the access cover is disposed on the gyro shell, a large-mass gyrostat capable of rotating at a high speed is disposed in an inner cavity of the gyro shell, the dy rotary table rotates relative to a main body of the pose control system of six-DOF motion, the gyro shell rotates along the dx rotary shaft, and the extension interface is arranged at a lower end part of the gyro pose control system.

8. The self-propelled towing simulator for the deep-sea mining system applicable to natural water bodies according to claim 7, wherein the experimental hydraulic lift rigid-tube model is connected to the center-of-gravity projection hole of the workbench through a lock-carrying universal joint, or, passed through the center-of-gravity projection hole to be directly connected to the extension interface through the lock-carrying universal joint.

9. A simulation method for simulating using a self-propelled towing simulator for a deep-sea mining system, wherein the simulation method comprises following steps:

at step 1: determining a buoyancy desired by the simulator according to parameters such as scale ratio, mass and self-buoyancy of a to-be-tested experimental model, and then determining a mass of fillings required in the cavity of a floating body unit of the simulator;

at step 2: mounting a removable battery box at a center of a rear end of a workbench of the simulator;

at step 3: lowering the simulator to a water surface through a wharf or mother ship, turning on a main power switch located on a panel of a central control cabinet to carry out all-round self-inspection and no-load running-in and acquire data as experimental control sample data and zero point punctuation reference, so as to confirm that the simulator is normal state;

at step 4: lowering the to-be-tested experimental model to the water surface through the wharf or mother ship, and connecting an experimental hydraulic lift rigid-tube model part of the to-be-tested experimental model to a center-of-gravity projection hole part at a lower part of the workbench through a lock-carrying universal joint;

at step 5: detecting a pose of the simulator, and if the simulator deflects, performing an overall pose balancing of the simulator by adjusting a position of the removable battery box back and forth or right and left on a upper work surface of the workbench;

at step 6: according to working condition requirements of an experiment, performing program setting remotely through a console, to arbitrarily match each working condition simulation function of the simulator independently;

at step 7: performing preliminary processing for the data acquired by the simulator by the central control cabinet and then interacting the data with a remote console through the radio communication system;

at step 8: verifying, by experimenters, whether data acquired by each sensor of the simulator is valid and normal in real time, so as to control the progress of the experiment and adjust the scheme of the experiment; and at step 9: after the experiment is completed, recovering the simulator through the wharf or mother ship, then cleaning, maintaining and placing the simulator properly for next use.

10. The simulation method according to claim 9, wherein the working condition simulation functions of the simulator in step 6 comprise the following functions:

pose simulation: the simulator simulates six-DOF motion states including swaying, surging, yawing, rolling, pitching and heaving generated by a mining vessel through the collaborative linkage of a gyro pose control system and a six-DOF platform; intervention in the pose of the simulator may be positive or negative, so that the simulator is applied to uncontrollable natural water bodies to approximate to working conditions of the experimental requirements by reducing or increasing sway or swing;

towing navigation: a main propulsion system of a propulsion system, a first side propulsion system of the propulsion system and a second side propulsion system of the propulsion system carried on the simulator each are capable of independently controlling a propulsion angle and a propeller speed, such that, by changing the propeller speed, the simulator simulates the working conditions such as constant speed towing navigation, constant and variable speed towing navigation, variable acceleration towing navigation, various complicated mining path planned navigations and steering navigations of various radiuses;

steering towing navigation: the main propulsion system, the first side propulsion system and the second side propulsion system carried on the simulator each are capable of independently controlling a propulsion angle and a propeller speed, such that, by changing the propulsion angle and the propeller speed, various forms of curvilinear motions are realized so as to simulate the working conditions of various path planned towing navigations of a mining vessel;

excitation vibration: the gyro pose control system and the six-DOF platform carried on the simulator apply a high-frequency vibration to the simulator, and then transfer the high-frequency vibration to the experimental hydraulic lift rigid-tube model through a main body structure of the simulator, or, more directly produce the excitation vibration by means of making direct connection with the extension interface at a lower part of the gyro pose control system through a lock-carrying universal joint, so as to observe dynamic response characteristics of a hydraulic lift pipeline system; and switching of hinging and fixed connection: the lock-carrying universal joint has two horizontal shafts orthogonal to each other, which provides free rotations of two degrees of freedom, so that the lock-carrying universal joint connects a top end of the hydraulic lift rigid-tube to the simulator by hinging, connects the top end of the hydraulic lift rigid-tube to the simulator after independently restricting the rotation of any one of the two horizontal shafts, or connects the top end of the hydraulic lift rigid-tube to the simulator by fixed connection after restricting the rotations of the two horizontal shafts.

* * * * *